US007681540B2

(12) United States Patent
Watanabe et al.

(10) Patent No.: US 7,681,540 B2
(45) Date of Patent: Mar. 23, 2010

(54) CONTROL APPARATUS FOR AN INTERNAL COMBUSTION ENGINE

(75) Inventors: Shinji Watanabe, Chiyoda-ku (JP); Toru Tanaka, Chiyoda-ku (JP); Tatsuhiko Takahashi, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 85 days.

(21) Appl. No.: 12/146,926

(22) Filed: Jun. 26, 2008

(65) Prior Publication Data

US 2009/0125216 A1 May 14, 2009

(30) Foreign Application Priority Data

Nov. 14, 2007 (JP) ..... 2007-295779

(51) Int. Cl.
*F01L 1/34* (2006.01)

(52) U.S. Cl. ..... 123/90.15

(58) Field of Classification Search ..... 123/90.15, 123/90.16

See application file for complete search history.

(56) References Cited

U.S. PATENT DOCUMENTS

| | | | | |
|---|---|---|---|---|
| 5,363,817 | A * | 11/1994 | Ikeda et al. | 123/90.15 |
| 6,732,689 | B2 * | 5/2004 | Wada et al. | 123/90.17 |
| 2008/0017149 | A1 * | 1/2008 | Kokubo et al. | 123/90.16 |

FOREIGN PATENT DOCUMENTS

| | | | |
|---|---|---|---|
| JP | 09150646 | A | 6/1997 |
| JP | 11091398 | A | 4/1999 |
| JP | 11182270 | A | 7/1999 |
| JP | 11265203 | A | 9/1999 |
| JP | 2000345871 | A | 12/2000 |
| JP | 2001-234765 | A | 8/2001 |
| JP | 2004162662 | A | 6/2004 |
| JP | 2005023873 | A | 1/2005 |

OTHER PUBLICATIONS

Japanese Office Action, dated Oct. 6, 2009.

* cited by examiner

*Primary Examiner*—Thomas N Moulis
(74) *Attorney, Agent, or Firm*—Sughrue Mion, PLLC

(57) ABSTRACT

Provided is a control apparatus for an internal combustion engine which controls the internal combustion engine in such a manner as to prevent excessive overshoot of an actual phase angle at a time of phase angle feedback control. The control apparatus for an internal combustion engine includes: a unit for detecting an actual phase angle of a camshaft based on a crank angle signal and a cam angle signal; a unit for setting a target phase angle of the camshaft based on an operational state; and a unit for performing phase angle feedback control calculation such that the actual phase angle coincides with the target phase angle, to calculate an amount of operation for the hydraulic pressure control solenoid valve, in which: the phase angle feedback control calculation is started for a first time after a KEY is turned ON with an initial value of an integral term set to a predetermined value; the phase angle feedback control calculation is performed using a control gain obtained by multiplying a control gain at a time of normal control when a control difference is equal to or larger than a preset value during the phase angle feedback control; and the phase angle feedback control calculation is performed using the control gain at the time of normal control when the control difference is smaller than the preset value during the phase angle feedback control.

10 Claims, 15 Drawing Sheets

CONTROL APPARATUS FOR AN INTERNAL COMBUSTION ENGINE

BACKGROUND OF THE INVENTION

1. Field of the Invention

The present invention relates to a control apparatus for an internal combustion engine for controlling operation timings of an intake valve or an exhaust valve of the internal combustion engine.

2. Description of the Related Art

Conventionally, a valve timing control apparatus for an internal combustion engine changes a phase angle of a camshaft with respect to a crankshaft of the internal combustion engine, thereby changing timings for opening and closing an intake valve or an exhaust valve. This valve timing control apparatus is equipped with a crank angle sensor for outputting a crank angle signal when the crankshaft is at a reference rotational position, and a cam angle sensor for outputting a cam angle signal when the camshaft is at a reference rotational position. The valve timing control apparatus detects an actual phase angle of the camshaft based on detection signals from the crank angle sensor and the cam angle sensor, and performs phase angle feedback control such that the actual phase angle coincides with a target phase angle set based on an operational state of the internal combustion engine.

A variable camshaft phase mechanism, which is supplied with a hydraulic pressure controlled by a hydraulic pressure control solenoid valve, changes the phase angle of the camshaft with respect to the crankshaft.

The hydraulic pressure control solenoid valve, which is designed as a duty solenoid valve, controls the duty ratio of the voltage supplied to a solenoid to control the value of a current flowing therethrough, and selectively supplies a hydraulic pressure to an advancement chamber or a retardation chamber of the variable camshaft phase mechanism, so the camshaft is shifted to an advancement side or a retardation side. When the duty ratio assumes a holding duty value in the neighborhood of a median, the hydraulic pressure control solenoid valve simultaneously closes the advancement chamber and the retardation chamber, and controls the position thereof to a neutral position for simultaneously shutting off the supply of hydraulic pressures to the advancement chamber and the retardation chamber, so the phase angle of the camshaft is held.

In order to compensate for variations in the holding duty value for holding the hydraulic pressure control solenoid valve at the neutral position, which result from a tolerance, aged deterioration, and the like of the hydraulic pressure control solenoid valve, it is known to learn the holding duty value or store the learning value thereof into a backup RAM.

It is also known to use a fixed value stored in advance in a ROM as an initial value when the holding duty value is not learned at all, or when the learning value is lost by, for example, turning a battery OFF (disconnecting a terminal of the battery).

As a matter of course, however, owing to a certain variation width of the tolerance and aged deterioration, the fixed value of the holding duty set as described above may not coincide with the learning value for compensating for the tolerance and aged deterioration. In the case of such a deviation, therefore, when the fixed value of the holding duty value is used as the initial value, for example, during the battery being turned OFF, the actual position of the hydraulic pressure control solenoid valve in a holding state thereof deviates from the original neutral position. In consequence, the controllability of subsequent cam phase control also deteriorates.

Especially in a case where this deviation occurs on the advancement side and the target phase angle is set on the advancement side where the amount of valve overlap between the intake valve and the exhaust valve is intrinsically large, it is also known that the amount of valve overlap becomes excessively large, that the amount of internal EGR thereby becomes excessively large, with the result that a deterioration in combustibility may be caused.

Thus, this valve timing control apparatus sets the learning value of the holding duty as an initial value of an integral term of feedback control, and limits the target phase angle in a case where the holding duty has not been learned yet (e.g., see JP 2001-234765 A).

In this valve timing control apparatus for the internal combustion engine, however, the holding duty fluctuates due to changes in the resistance value of the hydraulic pressure control solenoid coil, which result from changes in oil temperature, or changes in battery voltage. Therefore, the actual value of the holding duty value deviates from the learning value thereof when the temperature of the hydraulic pressure control solenoid coil and the battery voltage in learning the holding duty are different respectively from the temperature and the voltage in setting the learning value of the holding duty as the initial value of the integral term at the beginning of phase angle feedback control.

In such a case, the actual position of the hydraulic pressure control solenoid valve in the holding state thereof deviates from the original neutral position when the learning value of the holding duty is set as the initial value of the integral term at the beginning of phase angle feedback control following the start of the internal combustion engine. Especially in a case where this deviation arises on the advancement side and the target phase angle is set on the advancement side where the amount of valve overlap between the intake valve and the exhaust valve is intrinsically large, the amount of valve overlap becomes excessively large. In consequence, the amount of internal EGR (amount of exhaust gas recirculation) becomes excessively large, so a deterioration in startability of the internal combustion engine is caused.

The target phase angle is limited in the case where the value of the holding duty has not been learned yet, so there is a limit to the control on the advancement side. In an internal combustion engine equipped with a valve timing control apparatus for changing timings for opening and closing an intake valve, the timing for closing the intake valve is retarded when the timings for opening/closing the intake valve are shifted too much to the retardation side in starting the internal combustion engine. Thus, the mixture sucked into a combustion chamber flows back into an intake pipe.

When the sucked mixture flows back into the intake pipe at the time of cranking, which is associated with an extremely low rotational speed of the internal combustion engine, a decrease in actual compression ratio is caused, so it becomes difficult to start the internal combustion engine. In particular, there is a problem in that the mixture is not sufficiently compressed despite cranking and hence a further deterioration in startability is caused when the internal combustion engine is at a low temperature, namely, when the mixture is small in volume.

SUMMARY OF THE INVENTION

It is an object of the present invention to provide a control apparatus for an internal combustion engine which controls the internal combustion engine in such a manner as to prevent the amount of valve overlap between an intake valve and an exhaust valve from becoming excessively large while making it possible to swiftly and smoothly reach a calculated value of an integral term corresponding to the holding of a hydraulic pressure control solenoid valve at a neutral position, and to prevent excessive overshoot of an actual phase angle at the time of phase angle feedback control.

According to the present invention, there is provided a control apparatus for an internal combustion engine which hydraulically drives a variable mechanism for continuously causing a rotational phase of a camshaft with respect to a crankshaft of the internal combustion engine to be variable by dint of a hydraulic pressure control solenoid valve to change timings for opening/closing at least one of an intake valve and an exhaust valve, the control apparatus including: a crank angle sensor for detecting a reference rotational position of the crankshaft; a cam angle sensor for detecting a reference rotational position of the camshaft; a unit for detecting an actual phase angle of the camshaft based on detection signals from the crank angle sensor and the cam angle sensor; a unit for detecting an operational state of the internal combustion engine; a unit for setting a target phase angle of the camshaft based on an operational state detected by the operational state detecting unit; and a unit for performing phase angle feedback control calculation so that that the actual phase angle coincides with the target phase angle, to calculate an amount of operation for the hydraulic pressure control solenoid valve, in which: the phase angle feedback control calculation is started for a first time after a KEY is turned ON with an initial value of an integral term set to a predetermined value; the phase angle feedback control calculation is performed using a control gain obtained by multiplying a control gain at a time of normal control when a control difference is equal to or larger than a preset value during the phase angle feedback control; and the phase angle feedback control calculation is performed using the control gain at the time of normal control when the control difference is smaller than the preset value during the phase angle feedback control.

The effects of the control apparatus for the internal combustion engine according to the present invention are that the calculated value of the integral term corresponding to the holding of the hydraulic pressure control solenoid valve at the neutral position can be reached swiftly and smoothly, that excessive overshoot of the actual phase angle at the time of phase angle feedback control can be prevented, and that the amount of valve overlap between the intake valve and the exhaust valve does not become excessively large and hence stable combustibility is ensured.

DETAILED DESCRIPTION OF THE PREFERRED EMBODIMENT

Figure 1:
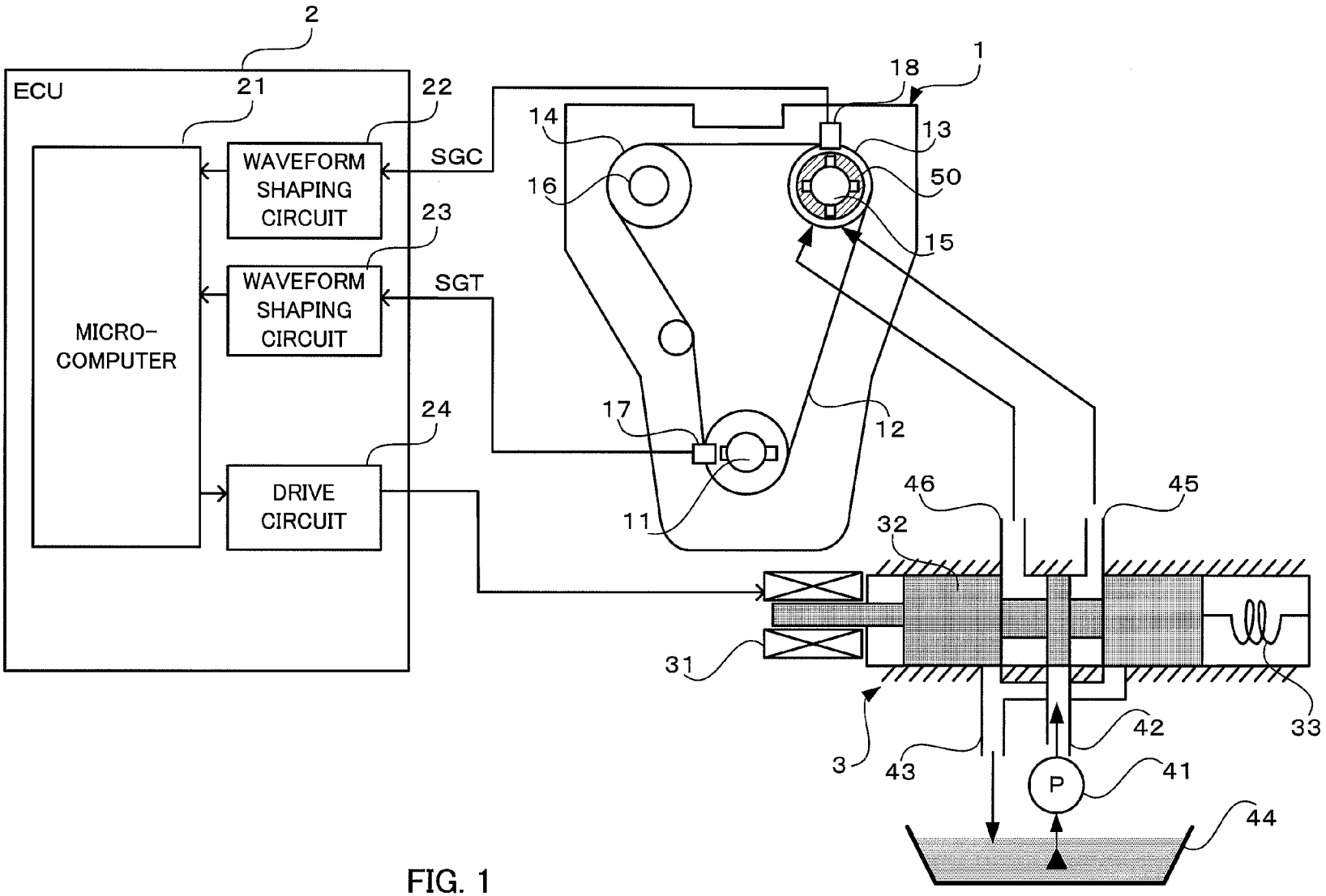
FIG. 1 is a schematic structural diagram of a control apparatus for an internal combustion engine according to an embodiment of the present invention.

FIG. 1 is a schematic structural diagram of a control apparatus for an internal combustion engine according to an embodiment of the present invention.

In an internal combustion engine 1 of the present invention, as shown in FIG. 1, a driving force is transmitted from a crankshaft 11 of the internal combustion engine 1 to a pair of timing pulleys 13 and 14 via a timing belt 12. A pair of camshafts 15 and 16 as driven shafts are disposed through the pair of the timing pulleys 13 and 14, respectively, which are rotationally driven in synchronization with the crankshaft 11. An intake valve (not shown) and an exhaust valve (not shown) are driven to be opened/closed by the camshafts 15 and 16. The intake valve and the exhaust valve are thus driven to be opened/closed in synchronization with rotation of the crankshaft 11 and vertical movements of a piston (not shown). That is, the intake valve and the exhaust valve are driven at predetermined opening/closing timings in synchronization with a series of four strokes in the internal combustion engine 1, namely, a suction stroke, a compression stroke, an explosion (expansion) stroke, and an exhaust stroke.

A crank angle sensor 17 and a cam angle sensor 18 are disposed on the crankshaft 11 and the camshaft 15, respectively. A crank angle signal SGT output from the crank angle sensor 17 and a cam angle signal SGC output from the cam angle sensor 18 are input to an electronic control unit (hereinafter, referred to as "ECU") 2.

Given that the number of pulses of the crank angle signal SGT from the crank angle sensor 17 is N while the crankshaft 11 rotates by 360°, the number of pulses of the cam angle signal SGC from the cam angle sensor 18 is 2N while the camshaft 15 rotates by 360°.

Given that VTmax° CA (crank angle) denotes a maximum value of a timing conversion angle of the camshaft 15, the number N of pulses is set equal to or smaller than (360/VTmax). Thus, the crank angle signal SGT from the crank angle sensor 17 and the cam angle signal SGC from the cam angle sensor 18 can be used in calculating an actual phase angle VTa.

The ECU 2 is equipped with a well-known microcomputer 21. The ECU 2 outputs a DUTY drive signal as an operation amount Dout calculated through phase angle feedback control (hereinafter, referred to as "phase angle F/B control") calculation to a linear solenoid coil 31 of a hydraulic pressure control solenoid valve (also referred to as oil control valve, and hereinafter, referred to as "OCV") 3 as a phase angle control actuator, via a drive circuit 24, such that the actual phase angle VTa of the camshaft 15 or 16 with respect to the crankshaft 11, which is detected based on the crank angle signal SGT and the cam angle signal SGC, coincides with a target phase angle VTt set based on an operational state of the internal combustion engine 1.

In the OCV 3, a current value of the linear solenoid coil 31 is controlled by the DUTY drive signal from the ECU 2, so a spool 32 is positioned at a position ensuring balance with an urging force of a spring 33. Depending on the position of the spool 32, a supply oil passage 42 communicates with a supply oil passage 45 on a retardation side or a supply oil passage 46 on an advancement side. A pump 41 then force-feeds oil in an oil tank 44 to a valve timing control mechanism 50 (a hatched region of FIG. 1) provided on one of the camshafts 15.

Owing to the adjustment of the amount of the oil supplied to this valve timing control mechanism 50, the camshaft 15 is rotatable with respect to the timing pulley 13, namely, the crankshaft 11 with a predetermined difference in phase. Thus, the camshaft 15 can be set at the target phase angle. The oil flowing from the valve timing control mechanism 50 is caused to flow back into the oil tank 44 through a discharge oil passage 43.

Figure 2:
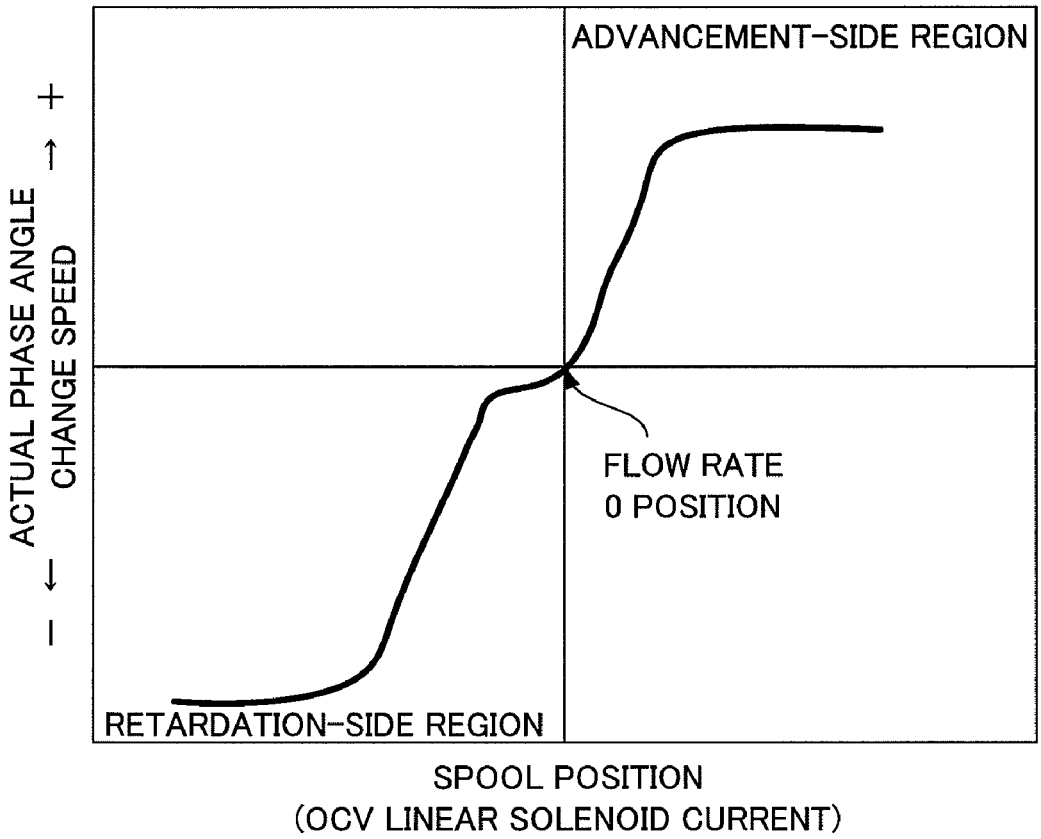
FIG. 2 is a diagram showing a relationship between a phase angle change speed of a phase angle control actuator and a position of a spool.

FIG. 2 is a characteristic diagram showing a relationship between a position of the spool 32 (hereinafter, referred to as "spool position") in the OCV 3 and a speed of change in the actual phase angle VTa (hereinafter, referred to as "actual phase angle change speed").

Referring to the characteristic diagram of FIG. 2, a region where the actual phase angle change speed is positive corresponds to an advancement-side region, and a region where the actual phase angle change speed is negative corresponds to a retardation-side region. The spool position, which is represented by an axis of abscissa of this characteristic diagram, is proportional to a linear solenoid current. When the spool position is a flow rate 0 position of FIG. 2 (a position where the flow rate output from the OCV 3 is 0), the supply oil passage 42 communicates with neither the supply oil passage 45 on the retardation side nor the supply oil passage 46 on the advancement side. At this spool position (which is identical to the neutral position), the actual phase angle VTa does not change. The relationship between the flow rate 0 position and the value of the linear solenoid current differs depending on an individual difference of the OCV 3, a deterioration in durability thereof, a difference in the operation environment thereof (oil temperature, engine rotational speed, and the like), and the like.

Thus, in JP 2001-234765 A, the drive DUTY value at the time when phase angle F/B control is performed to control the spool 32 to the state of the flow rate 0 position is learned as the holding DUTY value and set as an initial value of an integral term at the beginning of phase angle F/B control.

Next, the microcomputer 21 will be described. The microcomputer 21 is composed of a central processing unit (not shown) (hereinafter, referred to as "CPU") for making various calculations and determinations, a ROM (not shown) in which predetermined control programs and the like are stored in advance, a RAM (not shown) for temporarily storing a calculation result from the CPU and the like, an A/D converter (not shown) for converting an analog voltage into a digital value, a counter (not shown) for measuring the period of an input signal and the like, a timer (not shown) for measuring the drive time of an output signal and the like, an output port (not shown) serving as an output interface, and a common bus (not shown) for connecting respective blocks.

Signals from an operational state detecting unit for detecting quantities indicating an operational state of the internal combustion engine 1, that is, an air amount, a throttle opening degree, a battery voltage, a coolant temperature, and an oil temperature are input to the microcomputer 21.

Figure 3:
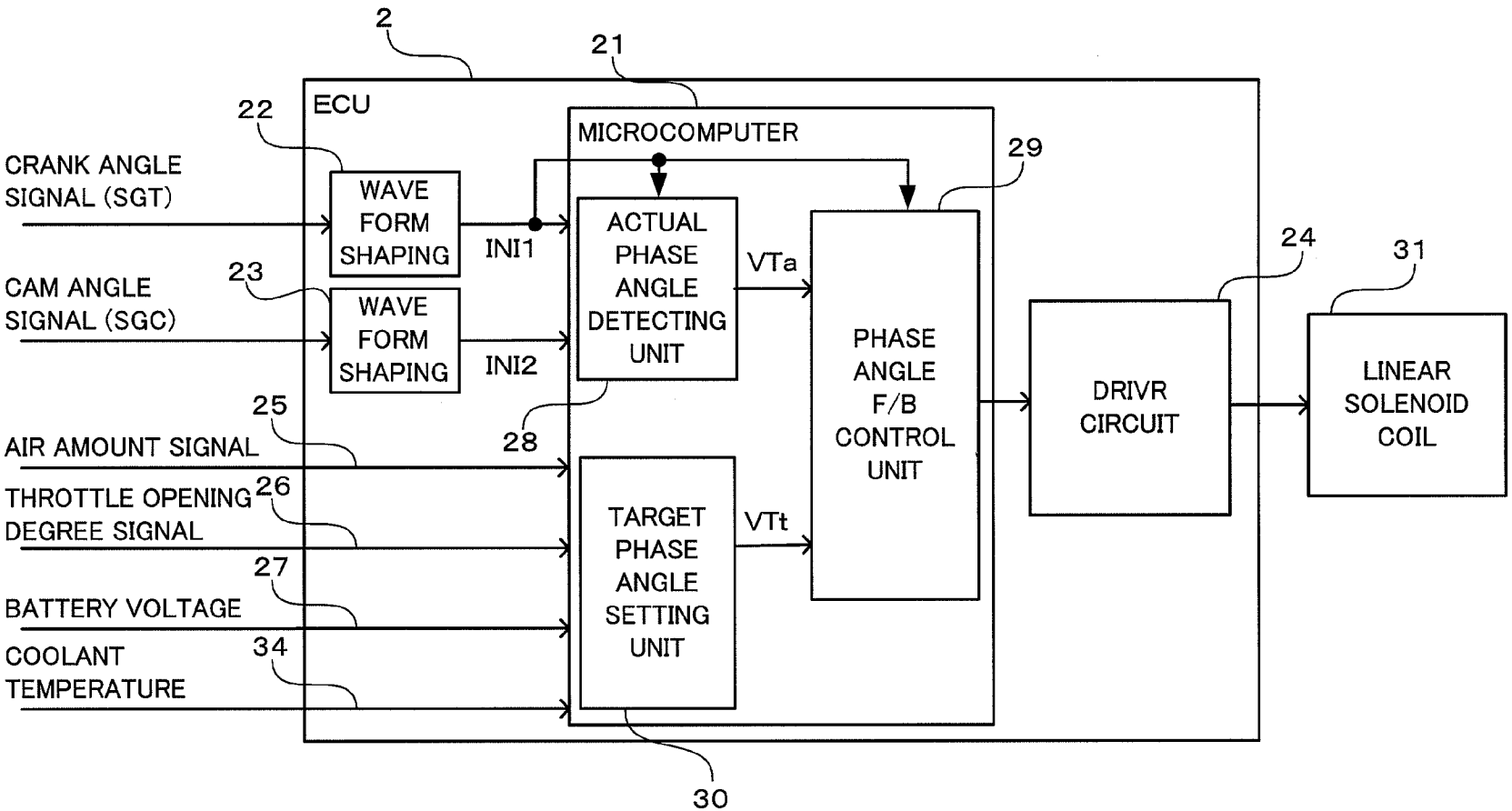
FIG. 3 is a block diagram conceptually showing functions processed within a microcomputer according to the embodiment of the present invention.
Figure 4:
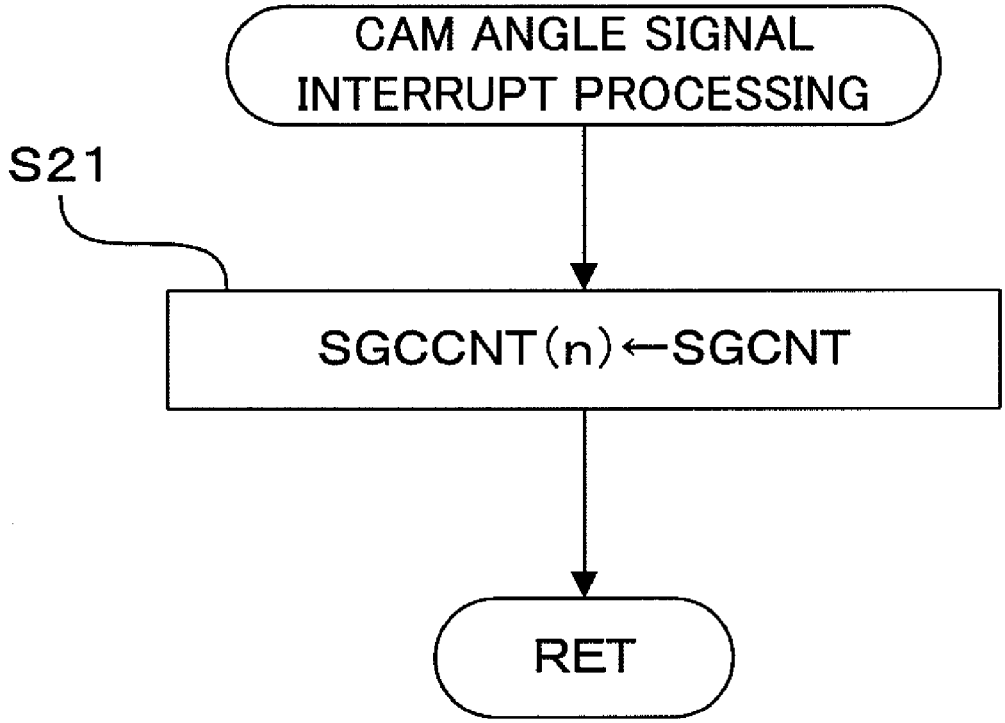
FIG. 4 is a flowchart showing a procedure of a cam angle signal interrupt processing.
Figure 5:
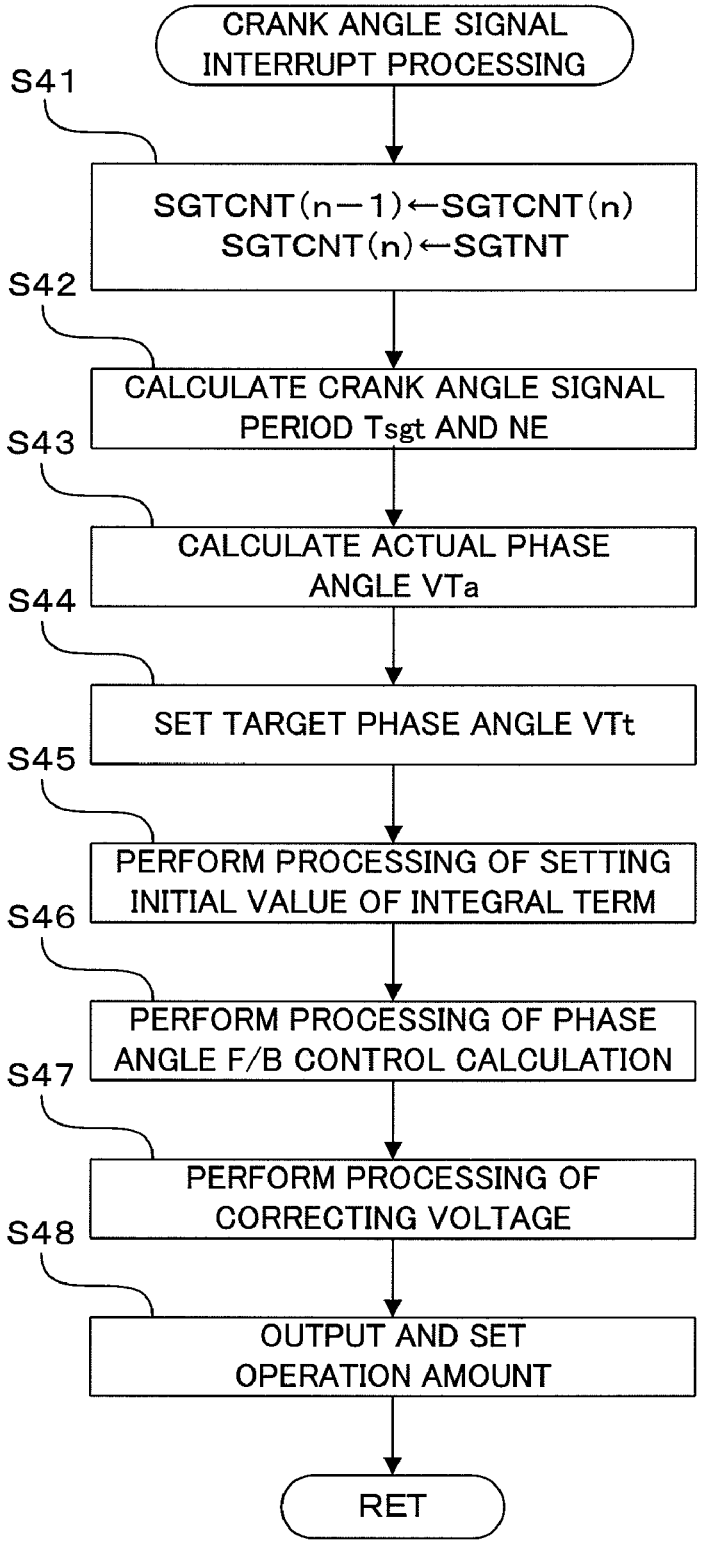
FIG. 5 is a flowchart showing a procedure of a crank angle signal interrupt processing.

FIG. 3 is a functional block diagram conceptually showing the basic configuration of processings performed in the microcomputer 21 as to valve timing control of the internal combustion engine 1 of the embodiment of the present invention. This functional block diagram illustrates the functions of operation programs in the microcomputer 21. FIG. 4 is a flowchart showing the procedure of an interrupt processing of the cam angle signal SGC. FIG. 5 is a flowchart showing the procedure of an interrupt processing of the crank angle signal SGT.

When the cam angle signal SGC is input to the ECU 2 from the cam angle sensor 18, a waveform shaping circuit 23 of the ECU 2 shapes the waveform of the cam angle signal SGC, and outputs an interrupt command signal INI2. The interrupt command signal INI2 is input to the microcomputer 21.

As shown in the flowchart of FIG. 4, every time the interrupt command signal INI2 causes interruption, the microcomputer 21 reads a counter value SGCNT of the counter (not shown) and stores the read counter value SGCNT into the RAM (not shown) as a current counter value SGCCNT(n) in Step S21. It should be noted that (n) of SGCCNT(n) indicates that this value is read when the present cam angle signal SGC is input. The value read when the last cam angle signal SGC is input is denoted by SGCCNT(n−1).

When the crank angle signal SGT is input to the ECU 2 from the crank angle sensor 17, a waveform shaping circuit 22 of the ECU 2 shapes the waveform of the crank angle signal SGT, and outputs an interrupt command signal INI1. This interrupt command signal INI1 is input to the microcomputer 21.

As shown in the flowchart of FIG. 5, every time the interrupt command signal INI1 causes interruption, the microcomputer 21 reads from the RAM a counter value SGTCNT(n), which is read and stored at the time of the input of the last crank angle signal SGT, stores the read value into the RAM as a last counter value SGTCNT(n−1), reads the counter value SGTCNT of the counter, which is read at the time of the input of the present crank angle signal SGT, and stores the read value into the RAM as the present counter value SGTCNT(n), in Step S41.

Then in Step S42, the microcomputer 21 calculates a period Tsgt {=SGTCNT(n)−SGTCNT(n−1)} of the crank angle signal SGT from a difference between the counter value SGTCNT(n−1), which is read at the time of the input of the last crank angle signal SGT, stored into the RAM, read again from the RAM, and stored as the last counter value, and the counter value SGTCNT(n) of the counter at the time of the input of the present crank angle signal SGT, and further calculates a rotational speed NE of the internal combustion engine 1 based on the crank angle signal period Tsgt.

Then in Step S43, the microcomputer 21 reads from the RAM the present counter value SGCCNT(n) at the time of the input of the cam angle signal SGC, calculates a phase difference time ΔTd (a phase difference time at the time of maximum retardation) or a phase difference time ΔTa (a phase difference time at the time of advancement) from a difference between the read value and the present counter value SGTCNT(n) at the time of the input of the present crank angle signal SGT, and calculates the actual phase angle VTa based on the period Tsgt of the crank angle signal SGT and a reference crank angle (180° CA). Details of a method of this calculation will be described later.

Then in Step S44, the microcomputer 21 subjects an air amount signal 25, a throttle opening degree signal 26, a battery voltage signal 27, a coolant temperature signal 34, and the like to processings such as removal of noise components, amplification, and the like, via an input I/F circuit, inputs the signals to the A/D converter to convert the signals into digital data, respectively, and sets the target phase angle VTt based on the amount of air, the rotational speed NE of the internal combustion engine 1, and the like by dint of a target phase angle setting unit 30.

Figure 10:
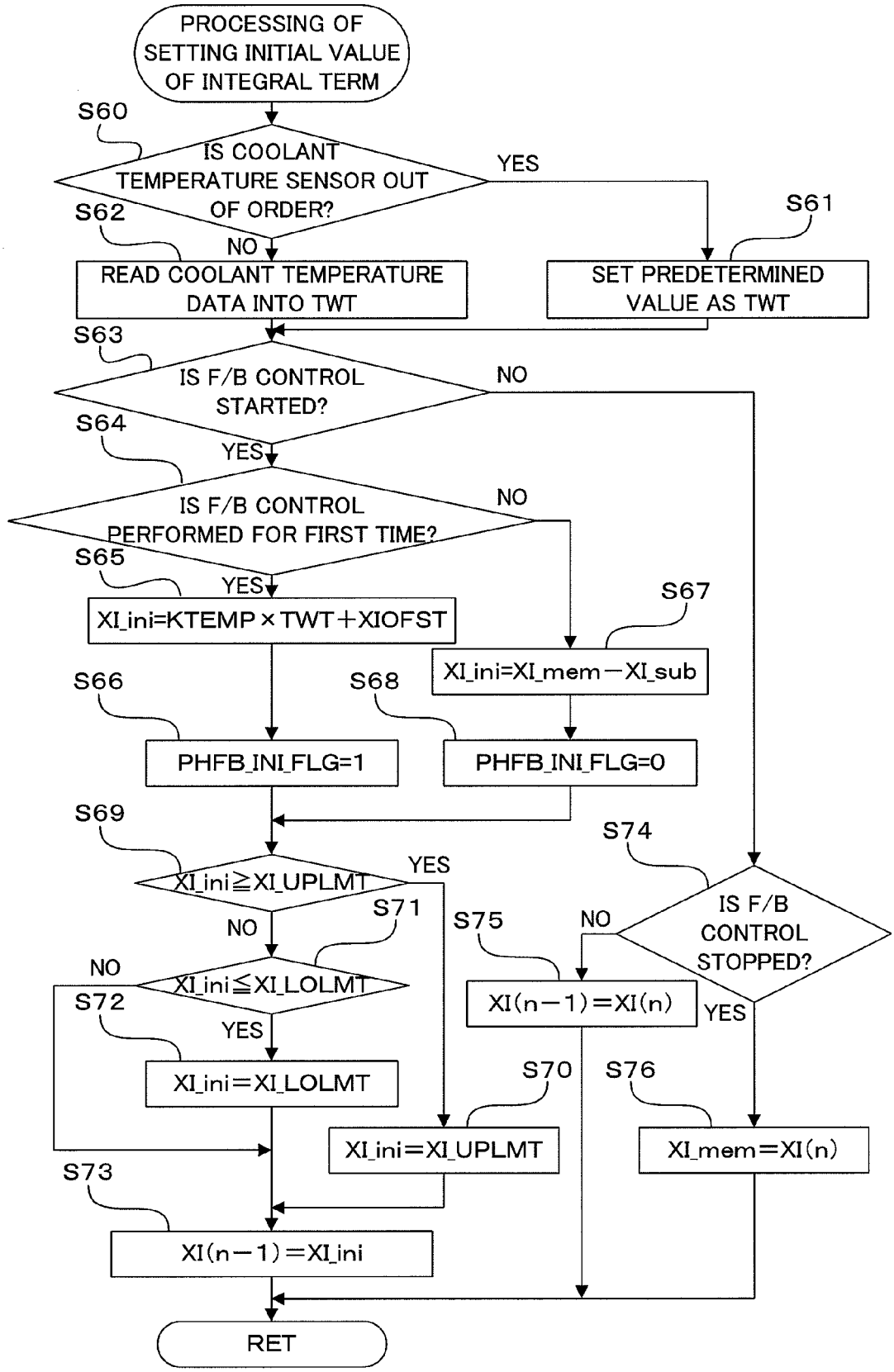
FIG. 10 is a flowchart showing a procedure of a processing for setting an initial value of an integral term of the present invention.

Then in Step S45, the microcomputer 21 calculates and sets the initial value of the integral term at the beginning of phase angle F/B control in starting the engine, based on a coolant temperature signal TWT, according to a calculation formula. Details of the processing of setting the initial value of the integral term will be described later (FIG. 10).

Then in Step S46, the microcomputer 21 calculates a control correction amount Dpid through phase angle F/B control calculation as PID control calculation, by dint of a phase angle F/B control unit 29, such that the actual phase angle VTa detected by an actual phase angle detecting unit 28 based on the crank angle signal SGT and the cam angle signal SGC coincides with the target phase angle VTt set by the target phase angle setting unit 30 based on data on the amount of air, the rotational speed of the internal combustion engine 1, and the like.

Then in Step S47, the microcomputer 21 corrects the control correction amount Dpid calculated through phase angle F/B control calculation, using a battery voltage correction coefficient KVB obtained as a ratio between a predetermined reference voltage and a battery voltage, thereby calculating the operation amount Dout (the drive DUTY value).

Then in Step S48, the microcomputer 21 sets the calculated operation amount Dout (the drive DUTY value) into a pulse width modulation timer (not shown) (hereinafter, referred to as "PWM timer").

Thus, the microcomputer 21 outputs a PWM drive signal, which is output from the PWM timer at intervals of a predetermined PWM drive period set in advance, to the OCV linear solenoid coil 31 via the drive circuit 24.

Figure 6:
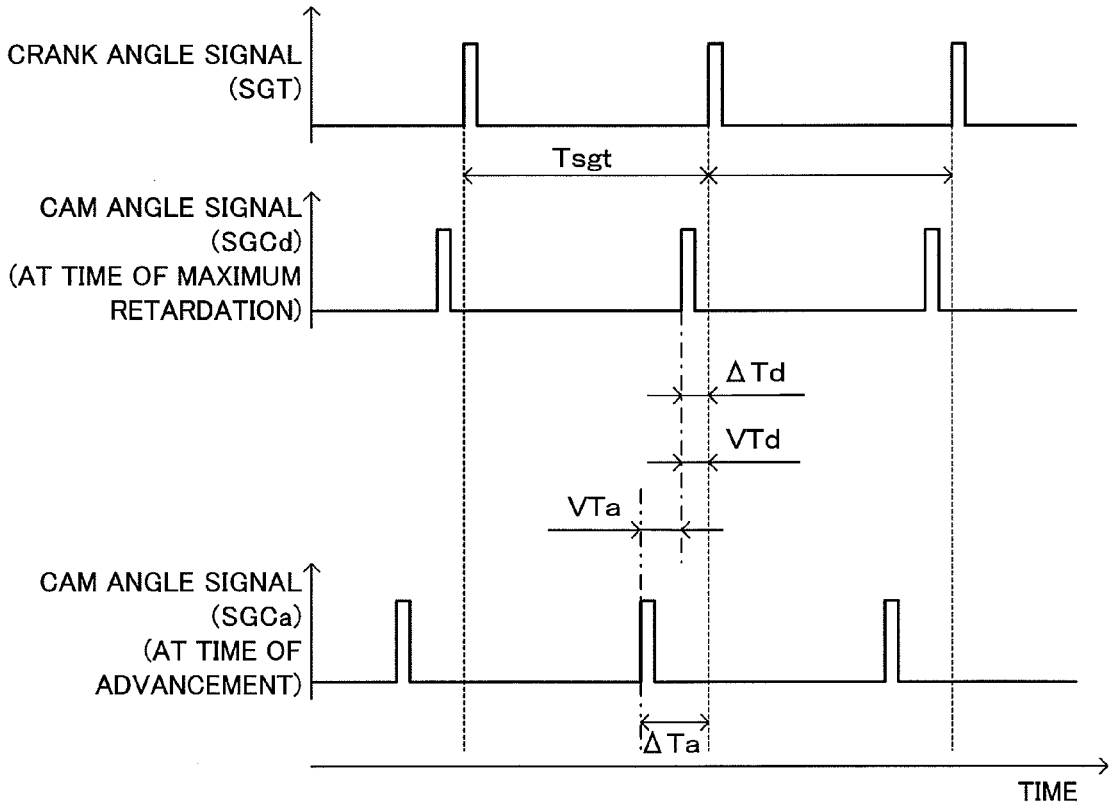
FIG. 6 is a diagram composed of timing charts of a crank angle signal, a cam angle signal at a time of maximum retardation, and a cam angle signal at a time of advancement.

FIG. 6 is composed of timing charts showing a relationship among the crank angle signal SGT, a cam angle signal SGCd at the time of maximum retardation, and a cam angle signal SGCa at the time of advancement. FIG. 6 illustrates a relationship in phase among the crank angle signal SGT and the cam angle signals SGCd and SGCa, and a method of performing the processing of calculating the actual phase angle VTa.

A method of detecting the actual phase angle VTa by dint of the actual phase angle detecting unit 28 based on the crank angle signal SGT and the cam angle signal SGC on the assumption that a phase angle of the camshaft 15 relative to the crankshaft 11 is an actual phase angle will be described with reference to FIG. 6.

The microcomputer 21 measures the period Tsgt {=SGTCNT(n)−SGTCNT(n−1)} of the crank angle signal SGT, and measures the phase difference time ΔTa {=SGTCNT(n)−SGCCNT(n)} from the cam angle signal SGCa at the time of advancement to the crank angle signal SGT.

Further, the microcomputer 21 calculates a most retarded valve timing VTd based on the phase difference time ΔTd {=SGTCNT(n)−SGCCNT(n)} measured in a case where the valve timing is in a most retarded state and the crank angle signal period Tsgt, according to a formula (1), and stores the most retarded valve timing VTd into the RAM in the microcomputer 21. It should be noted that 180(° CA) is a reference crank angle at which the crank angle signal SGT is generated in a four-cylinder internal combustion engine.

$$VTd=(\Delta Td/Tsgt)\times 180(^\circ\ CA) \tag{1}$$

The microcomputer 21 calculates the actual phase angle VTa based on the phase difference time ΔTa at the time of advancement, the crank angle signal period Tsgt, and the most retarded valve timing VTd, according to a formula (2).

$$VTa=(\Delta Ta/Tsgt)\times 180(^\circ\ CA)-VTd \tag{2}$$

Figure 7:
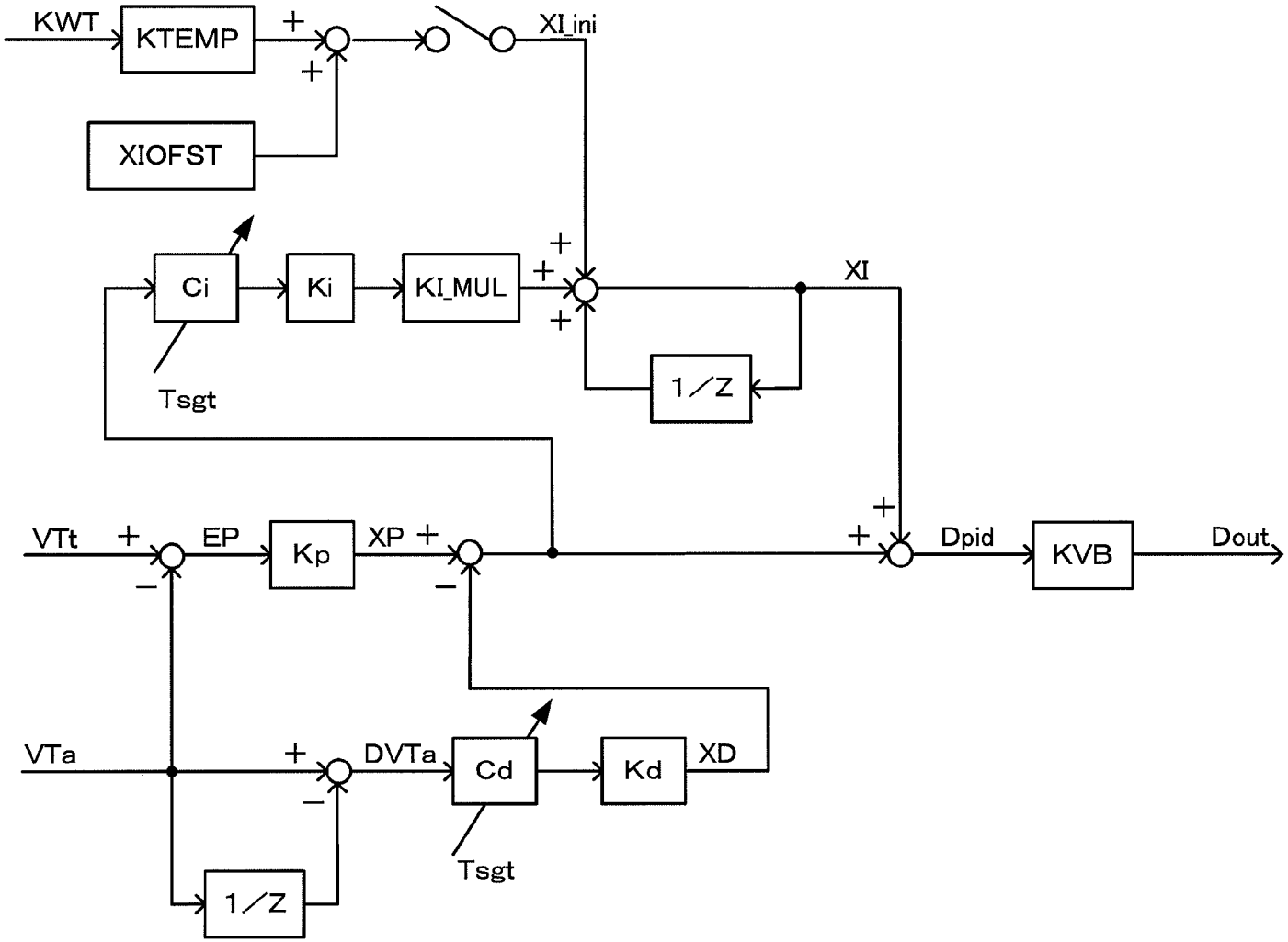
FIG. 7 is a block diagram of PID control in phase angle F/B control.

FIG. 7 is a block diagram of PID control in a case where the phase angle F/B control unit 29 of the embodiment of the present invention performs phase angle F/B control in synchronization with the crank angle signal SGT and through PID control calculation every time the crank angle signal SGT is input. Referring to the block diagram of PID control shown in FIG. 7, each control block of 1/Z represents a well-known hold element with one sample delay.

In starting phase angle F/B control, the phase angle F/B control unit 29 calculates and sets an initial value (XI_ini) of an integral term of PID control according to a calculation formula made up of data on the temperature of coolant (TWT), a temperature coefficient (KTEMP), and an offset value (XIOFST).

Next, a PID control calculation processing will be described.

To cause the actual phase angle VTa detected according to the formula (2) based on the crank angle signal SGT and the cam angle signal SGC to follow the target phase angle VTt set in accordance with the operational state of the internal combustion engine 1, a phase angle difference EP between the target phase angle VTt and the actual phase angle VTa is first obtained according to a formula (3).

$$EP=VTt-VTa \tag{3}$$

A speed of change in the actual phase angle VTa (hereinafter, referred to as "the actual phase angle change speed") DVTa is obtained from an actual phase angle VTa(n) detected at the timing of the present crank angle signal SGT(n) and an actual phase angle VTa(n−1) detected at the timing of the last crank angle signal SGT(n−1), according to a formula (4). It should be noted in the formula (4) that (n) denotes the timing when the present actual phase angle VTa is detected, and that (n−1) denotes the timing when the last actual phase angle VTa is detected.

$$DVTa=VTa(n)-VTa(n-1) \tag{4}$$

The control correction amount Dpid is calculated based on the phase angle difference EP and the speed DVTa of change in the actual phase angle, according to a formula (5) of PID control calculation. It should be noted in the formula (5) that XP denotes a calculated value of a proportional term, that XI denotes a calculated value of the integral term, and that XD denotes a calculated value of a differential term.

$$Dpid=XP+XI-XD \tag{5}$$

The calculated value XP of the proportional term is calculated based on the phase angle difference EP and a proportional gain Kp, according to a formula (6).

$$XP=Kp\times EP \tag{6}$$

As expressed by a formula (7), a present calculated value XI(n) of the integral term is obtained by adding a present added value, which is calculated as a product of a value obtained by subtracting the calculated value XD of the differential term from the calculated value XP of the proportional term, the first normalization coefficient Ci, an integral gain Ki, and an integral gain multiplication coefficient KI_MUL, to a last calculated value XI(n−1) of the integral term. The first normalization coefficient Ci and the integral gain multiplication coefficient KI_MUL will be described later in detail.

$$XI(n)=(XP-XD)\times Ci\times Ki\times KI_MUL+XI(n-1) \quad (7)$$

The initial value XI_ini of the integral term in starting phase angle F/B control is calculated based on a coolant temperature KWT, the temperature coefficient KTEMP set in advance, and the offset value XIOFST, according to a formula (8), and set as the last calculated value XI(n−1) of the integral term.

$$XI_ini=KWT\times KTEMP+XIOFST \quad (8)$$

As expressed by a formula (9), the calculated value XD of the differential term is a product of the actual phase angle change speed DVTa, the second normalization coefficient Cd, and a differential gain Kd. The second normalization coefficient Cd will be described later in detail.

$$XD=DVTa\times Cd\times Kd \quad (9)$$

The first normalization coefficient Ci in the formula (7) for calculating the integral term is obtained based on the crank angle signal period Tsgt and a predetermined reference period Tbase (e.g., 15 milliseconds), according to a formula (10).

$$Ci=Tsgt/T\text{base} \quad (10)$$

Figure 8:
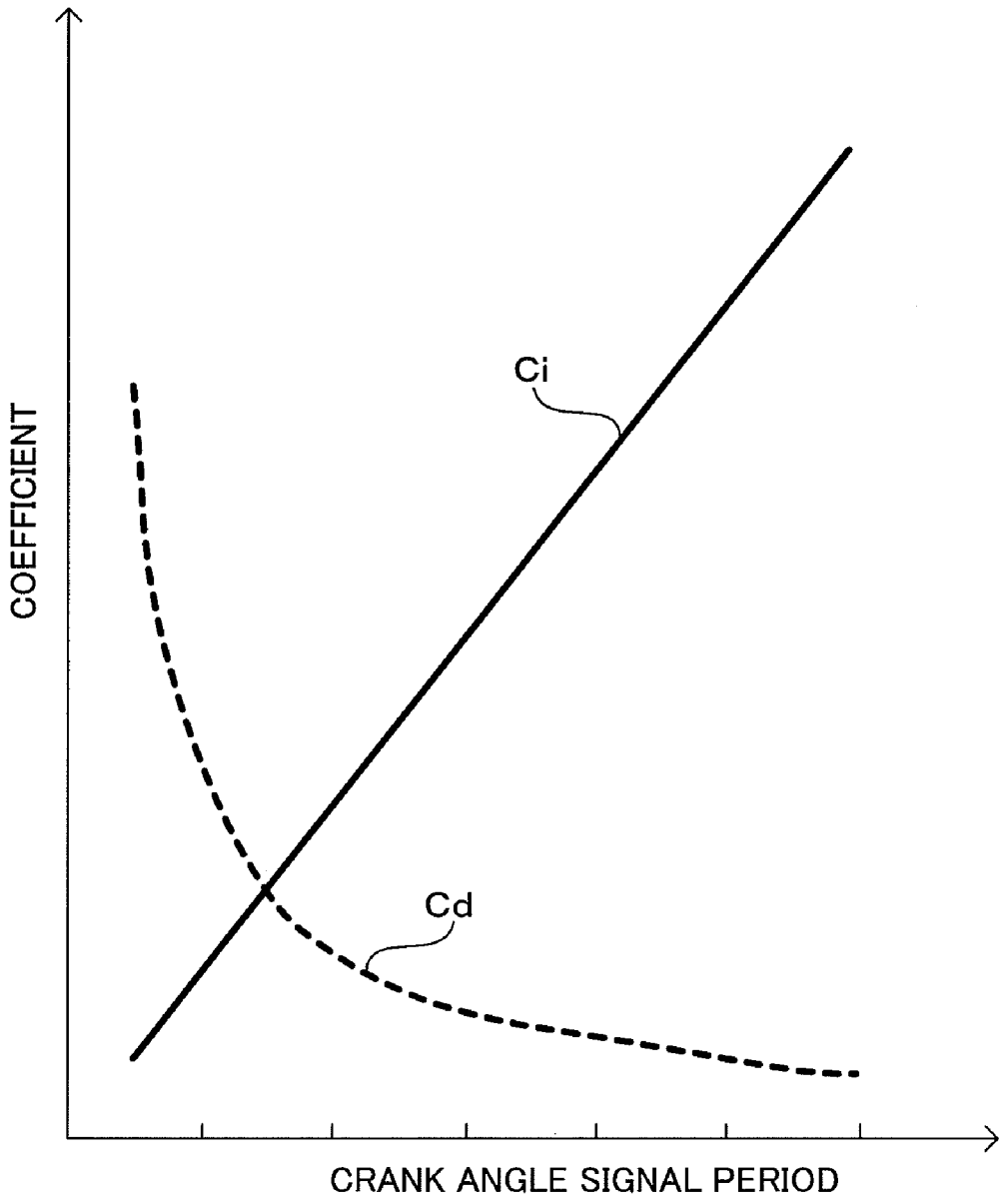
FIG. 8 is a diagram showing a relationship between a crank angle signal period and normalization coefficients Ci and Cd.

FIG. 8 shows a relationship between the first normalization coefficient Ci obtained according to the formula (10) and the crank angle signal period Tsgt. The first normalization coefficient Ci also changes in proportion to the crank angle signal period Tsgt. Therefore, even when the phase angle difference EP remains constant, the calculation period of phase angle F/B control changes due to a change in the crank angle signal period Tsgt, the amount of correction of the operation amount by the integral term can be held steady by the first normalization coefficient Ci, so the amount of correction by the integral term does not become excessive or deficient as a result of the change in the crank angle signal period Tsgt. Thus, the amount of overshoot or undershoot can be suppressed while ensuring the responsiveness of the actual phase angle, and phase angle F/B control can be performed in synchronization with the crank angle signal SGT.

The second normalization coefficient Cd in the formula (9) for calculating the differential term is obtained based on the predetermined reference period Tbase and the crank angle signal period Tsgt, according to a formula (11).

$$Cd=T\text{base}/Tsgt \quad (11)$$

FIG. 8 shows a relationship between the second normalization coefficient Cd obtained according to the formula (11) and the crank angle signal period Tsgt. The second normalization coefficient Cd also changes in inverse proportion to the crank angle signal period Tsgt. Therefore, even when the actual phase angle change speed DVTa remains constant, the calculation period of phase angle F/B control changes due to a change in the crank angle signal period Tsgt, and the detected value of the actual phase angle change speed DVTa changes, the amount of correction of the operation amount by the differential term can be held steady by the second normalization coefficient Cd, so the amount of correction by the differential term does not become excessive or deficient as a result of the change in the crank angle signal period Tsgt. Thus, the amount of overshoot or undershoot can be suppressed while ensuring the responsiveness of the actual phase angle, and phase angle F/B control can be performed in synchronization with the crank angle signal SGT.

Then, the control correction amount Dpid calculated through PID control calculation is corrected using a battery voltage correction coefficient KVB (=the predetermined reference voltage/VB), according to a formula (12), to exclude the influence of fluctuations in a battery voltage VB, and the operation amount Dout is calculated and output to the OCV linear solenoid coil 31 via the drive circuit 24.

$$Dout=Dpid\times KVB \quad (12)$$

Figure 9:
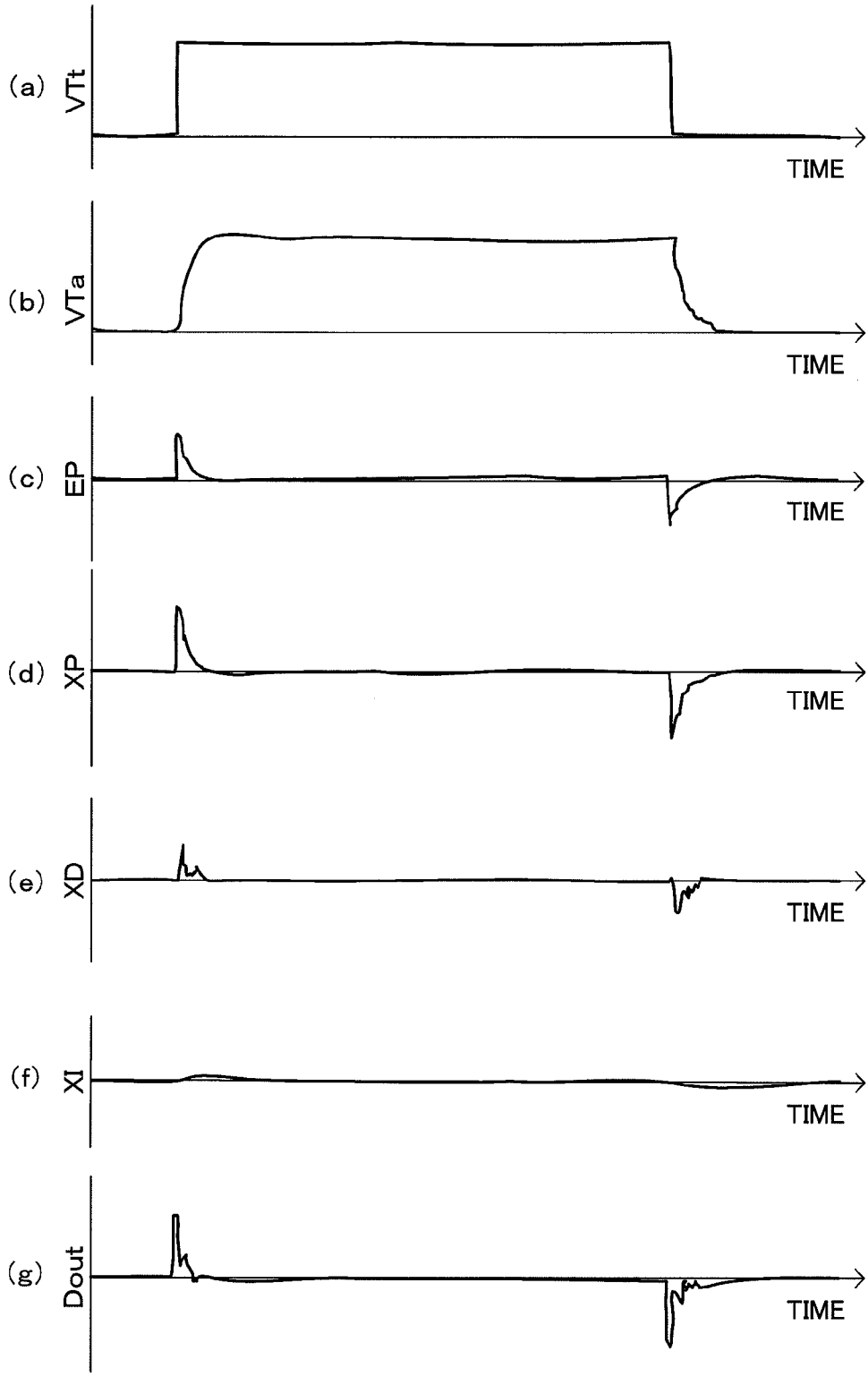
FIG. 9 are time charts at a time of phase angle F/B control.

FIG. 9 are time charts of respective calculated quantities at the time when the target phase angle VTt is changed stepwise and phase angle F/B control is performed through PID control calculation. Referring to FIG. 9, when the target phase angle VTt is changed stepwise to a predetermined value as shown in FIG. 9A, the responsive operation waveform of the actual phase angle VTa is shown in FIG. 9B, the control difference EP in the phase angle calculated through PID control calculation is shown in FIG. 9C, the calculated value XP of the proportional term is shown in FIG. 9D, the calculated value XD of the differential term is shown in FIG. 9E, the calculated value XI of the integral term is shown in FIG. 9F, and the operation amount Dout is shown in FIG. 9G.

It is apparent that the control is performed in the following manner. When the target phase angle VTt is changed stepwise, the calculated value XP of the proportional term, which is proportional to the control difference EP in the phase angle, corrects the operation amount Dout in an increasing direction. When the actual phase angle VTa starts to move, the calculated value XD of the differential term, which corresponds to the actual phase angle change speed DVTa, corrects the operation amount Dout in a decreasing direction. The calculated value XI of the integral term, which is obtained by integrating a difference between the calculated value XP of the proportional term and the calculated value XD of the differential term, increases or decreases the operation amount Dout. Thus, while the amount of overshoot of the actual phase angle VTa is suppressed, the position of the spool 32 of the OCV 3 is held at the flow rate 0 position when the actual phase angle VTa converges to the target phase angle VTt.

FIG. 10 is a flowchart showing the procedure of the processing of setting the initial value of the integral term in starting phase angle F/B control.

In Step S60, it is determined whether or not a coolant temperature sensor (not shown) is out of order. When the coolant temperature sensor is out of order, a transition to Step S61 is made. When the coolant temperature sensor is not out of order, a transition to Step S62 is made.

In Step S61, a predetermined value (e.g., 40° C.) is set as the coolant temperature data TWT, and a transition to Step S63 is made.

In Step S62, the coolant temperature detected by the coolant temperature sensor is set as the coolant temperature data TWT, and a transition to Step S63 is made.

In Step S63, it is determined whether or not PID control calculation of phase angle F/B control is started. When PID control calculation is started, a transition to Step S64 is made. When PID control calculation is not started, a transition to Step S74 is made.

In Step S64, it is determined whether or not phase angle F/B control is performed for the first time. When phase angle F/B control is performed for the first time, a transition to Step S65 is made. When phase angle F/B control is performed for the second time or thereafter, a transition to Step S67 is made.

In Step S65, the initial value XI_ini of the integral term is obtained based on the coolant temperature TWT, the temperature coefficient KTEMP, and the offset value XIOFST, according to a calculation formula (13).

$$XI_ini = TWT \times KTEMP + XIOFST \quad (13)$$

A method of deriving the formula (13) for calculating the initial value of the integral term will now be described.

A relationship according to a formula (14) is established among a tolerance lower limit IH_OCVLO of the current value for controlling the spool 32 of the OCV 3 to the neutral position (the flow rate 0 position), a tolerance lower limit R_SOLLO of the resistance value of the linear solenoid coil 31 of the OCV 3, a predetermined reference voltage (e.g., 14 V) in calculating the battery voltage correction coefficient KVB, and the operation amount DH_out in controlling the spool 32 of the OCV 3 to the neutral position.

$$DH_out = IH_OCVLO \times R_SOLLO / 14 \quad (14)$$

In the relational formula (14), as the temperature of the linear solenoid coil 31, which is estimated from the coolant temperature TWT, changes, the tolerance lower limit R_SOLLO of the resistance value of the linear solenoid coil 31 also changes. Therefore, the operation amount DH_out in controlling the spool 32 of the OCV 3 to the neutral position also changes.

Figure 12:
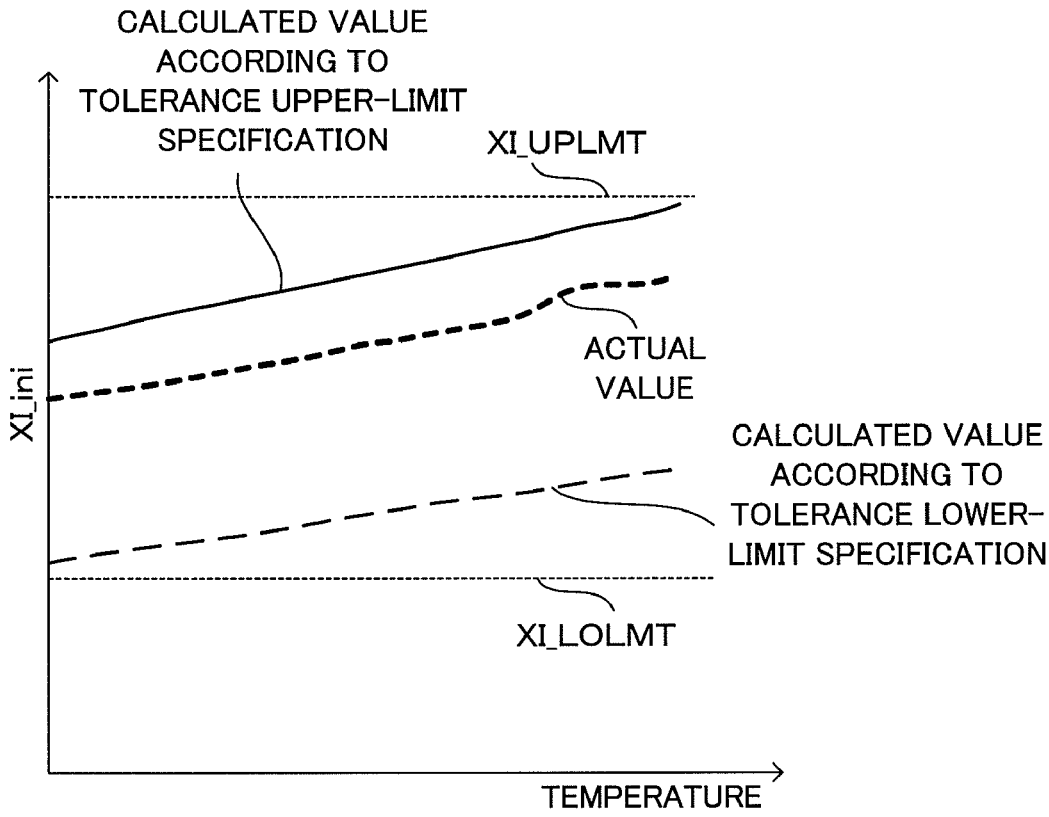
FIG. 12 is a diagram showing a relationship between the initial value of the integral term and temperature.

In FIG. 12, the operation amount DH_out in controlling the spool 32 of the OCV 3 to the neutral position, which is calculated according to the relational formula (14), is set as the initial value XI_ini of the integral term. As shown in FIG. 12, a calculated value according to a tolerance lower-limit specification of the OCV 3, a calculated value according to a tolerance upper-limit specification of the OCV 3, and the actual value of the integral term at the time when the actual phase angle converges to the target phase angle during phase angle F/B control in the case of a product according to a nominal specification of the OCV 3 are plotted against the temperature (the temperature of the linear solenoid coil 31 in the case of the tolerance lower-limit specification or the tolerance upper-limit specification, and the coolant temperature TWT in the case of the nominal specification).

In FIG. 12, XI_LOLMT denotes a lower limit within a tolerance of the setting of the initial value of the integral term, and XI_UPLMT denotes an upper limit within the tolerance. It is apparent from FIG. 12 that the temperature of the linear solenoid coil 31 can be estimated from the coolant temperature TWT. The formula (13) for calculating the initial value of the integral term is obtained as an approximation formula of the initial value XI_ini of the integral term according to the tolerance lower-limit specification of the OCV 3 from the temperature coefficient KTEMP and the offset value XIOFST, using the temperature characteristic of the initial value of the integral term shown in FIG. 12.

Referring back to the flowchart of FIG. 10, in Step S66, a phase angle feedback control initial flag PHFB_INI_FLG is set to 1 on the ground that phase angle F/B control is performed for the first time, and a transition to Step S69 is made.

When phase angle F/B control is not performed for the first time in Step S64, the initial value XI_ini of the integral term is calculated in Step S67 from a calculated value XI_mem of the integral term stored at the time of the last stoppage of phase angle F/B control and a subtracted value XI_sub set in advance to suppress the amount of overshoot of the actual phase angle, according to a calculation formula (15), and a transition to Step S68 is made.

$$XI_ini = XI_mem - XI_sub \quad (15)$$

In Step S68, the phase angle feedback control initial flag PHFB_INI_FLG is set to 0 on the ground that phase angle F/B control is not performed for the first time, and a transition to Step S69 is made.

Then in Step S69, it is determined whether or not the initial value XI_ini of the integral term calculated according to the calculation formula (13) or the calculation formula (15) is equal to or larger than the upper limit XI_UPLMT within the tolerance. When the initial value XI_ini of the integral term is equal to or larger than the upper limit XI_UPLMT within the tolerance, a transition to Step S70 is made. When the initial value XI_ini of the integral term is smaller than the upper limit XI_UPLMT within the tolerance, a transition to Step S71 is made.

In Step S70, the upper limit XI_UPLMT is set as the initial value XI_ini of the integral term, and a transition to Step S73 is made.

In Step S71, it is determined whether or not the initial value XI_ini of the integral term calculated according to the calculation formula (13) or the calculation formula (15) is equal to or smaller than the lower limit XI_LOLMT within the tolerance. When the initial value XI_ini of the integral term is equal to or smaller than the lower limit XI_LOLMT within the tolerance, a transition to Step S72 is made. When the initial value XI_ini of the integral term is larger than the lower limit XI_LOLMT within the tolerance, a transition to Step S73 is made.

In Step S72, the lower limit XI_LOLMT is set as the initial value XI_ini of the integral term, and a transition to Step S73 is made.

In Step S73, the calculated value XI_ini of the integral term thus set is stored into the RAM as the last calculated value XI(n−1) of the integral term, and the processing of setting the initial value of the integral term is terminated.

In Step S74, it is determined whether or not phase angle F/B control is stopped. When phase angle F/B control is continued, a transition to Step S75 is made. When phase angle F/B control is stopped, a transition to Step S76 is made.

In Step S75, the present calculated value XI(n) of the integral term is stored into the RAM as the last calculated value XI(n−1) of the integral term, and the processing of setting the initial value of the integral term is terminated.

In Step S76, the present calculated value XI(n) of the integral term is stored into the RAM as the calculated value XI_mem of the integral term stored at the time of the last stoppage of phase angle F/B control, and the processing of setting the initial value of the integral term is terminated.

Figure 11:
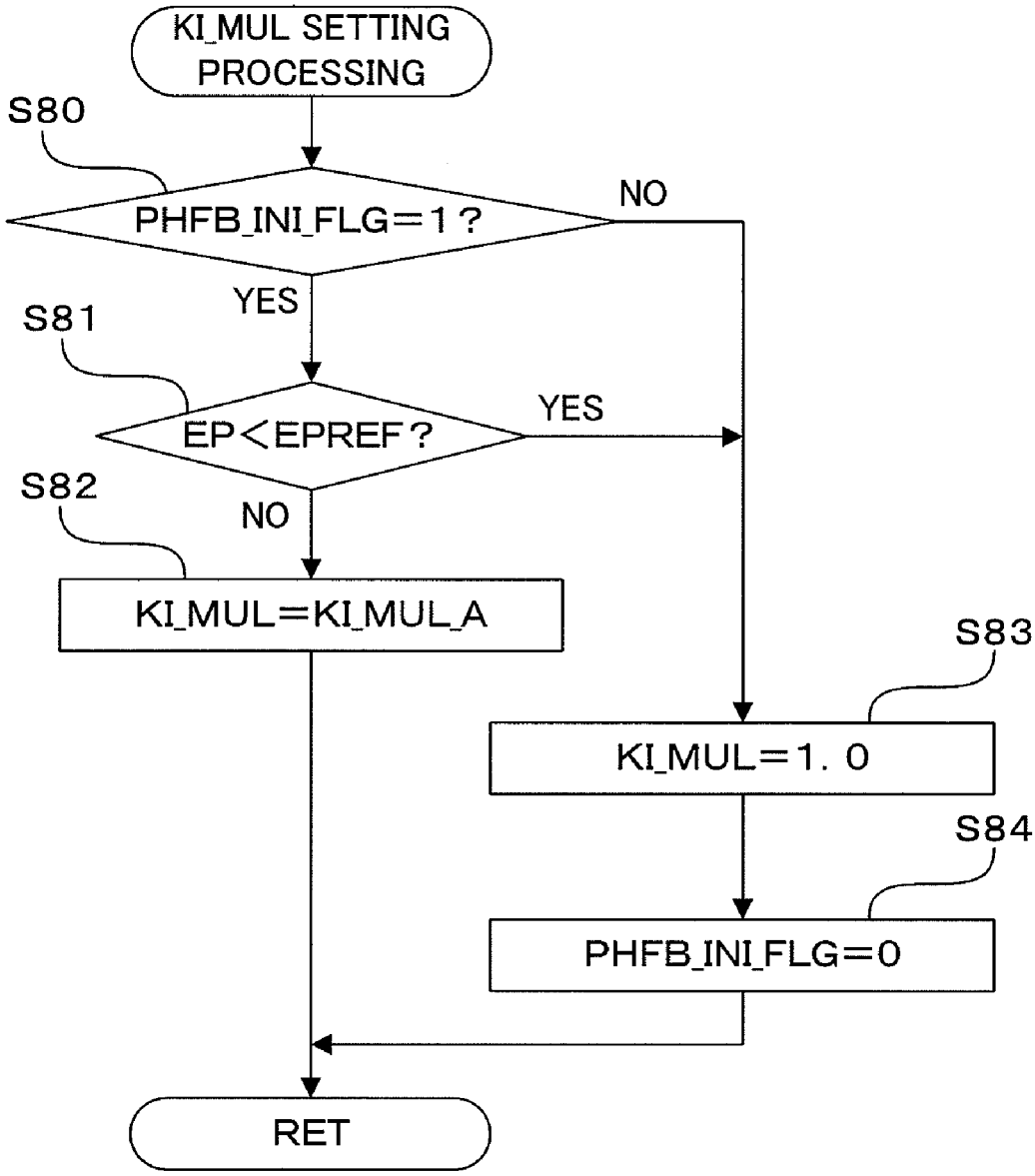
FIG. 11 is a flowchart of a KI_MUL setting processing of the present invention.

FIG. 11 is a flowchart showing the procedure of a processing of setting the integral gain multiplication coefficient KI_MUL used in the formula (7) for calculating the integral term.

In the case where phase angle F/B control is performed for the first time, while the control difference EP during phase angle F/B control is equal to or larger than a predetermined value EPREF, the integral gain multiplication coefficient KI_MUL is set to a predetermined large value K_MUL_A, for example, 4.0 to increase the integral gain. When the control difference EP converges to a value smaller than the predetermined value EPREF, the integral gain multiplication coefficient KI_MUL is returned to 1.0 such that the integral gain becomes equal to an integral gain at the time of normal control, and phase angle F/B control calculation is performed to quicken the convergence of the actual phase angle to the target phase angle at the time when phase angle F/B control is performed for the first time.

When the processing of setting the integral gain multiplication coefficient KI_MUL is started, it is determined in Step S80 whether or not the phase angle feedback control initial flag PHFB_INI_FLG is 1 to determine whether or not phase angle F/B control is performed for the first time. When the phase angle feedback control initial flag PHFB_INI_FLG is 1, a transition to Step S81 is made. When the phase angle feedback control initial flag PHFB_INI_FLG is 0, a transition to Step S83 is made.

In Step S81, it is determined whether or not the control difference EP has converged to a value smaller than the predetermined value EPREF (e.g., 2.0° CA). In the case where the control difference EP has converged to the value smaller than the predetermined value EPREF, a transition to Step S83 is made. When the control difference EP is equal to or larger than the predetermined value EPREF, a transition to Step S82 is made.

In Step S82, the integral gain multiplication coefficient KI_MUL is set to the preset value KI_MUL_A (e.g., 4.0), and the processing of setting the integral gain multiplication coefficient is terminated.

In Step S83, the integral gain multiplication coefficient KI_MUL is set to 1, and a transition to Step S84 is made.

In Step S84, the phase angle feedback control initial flag PHFB_INI_FLG is set to 0 and hence cleared, and the processing of setting the integral gain multiplication coefficient is terminated.

When the control difference EP is larger than, for example, 2.0° CA, the integral gain multiplication coefficient KI_MUL is set to, for example, 4.0. Thus, the integral gain for controlling a value obtained by subtracting the calculated value XD of the differential term from the calculated value XP of the proportional term becomes equal to 4KI, so the time for convergence is reduced.

On the other hand, in a case where the control difference EP has converged to a value equal to or smaller than, for example, 2.0° CA, the integral gain multiplication coefficient KI_MUL is set to, for example, 1.0 to restore a normal time for convergence.

As described above, even in the case where the initial value of the integral term is set according to the formula (13) for calculating the initial value of the integral term, which is set in advance according to the OCV tolerance (the current value for holding the spool 32 at the neutral position, the resistance value of the linear solenoid coil 31) lower-limit specification, when phase angle F/B control is performed for the first time, phase angle F/B control calculation is performed with the integral gain set larger than the integral gain at the time of normal control until the control difference EP converges to the value equal to or smaller than the predetermined value. Thus, the convergence of the actual phase angle to the target phase angle can be quickened.

Figure 13:
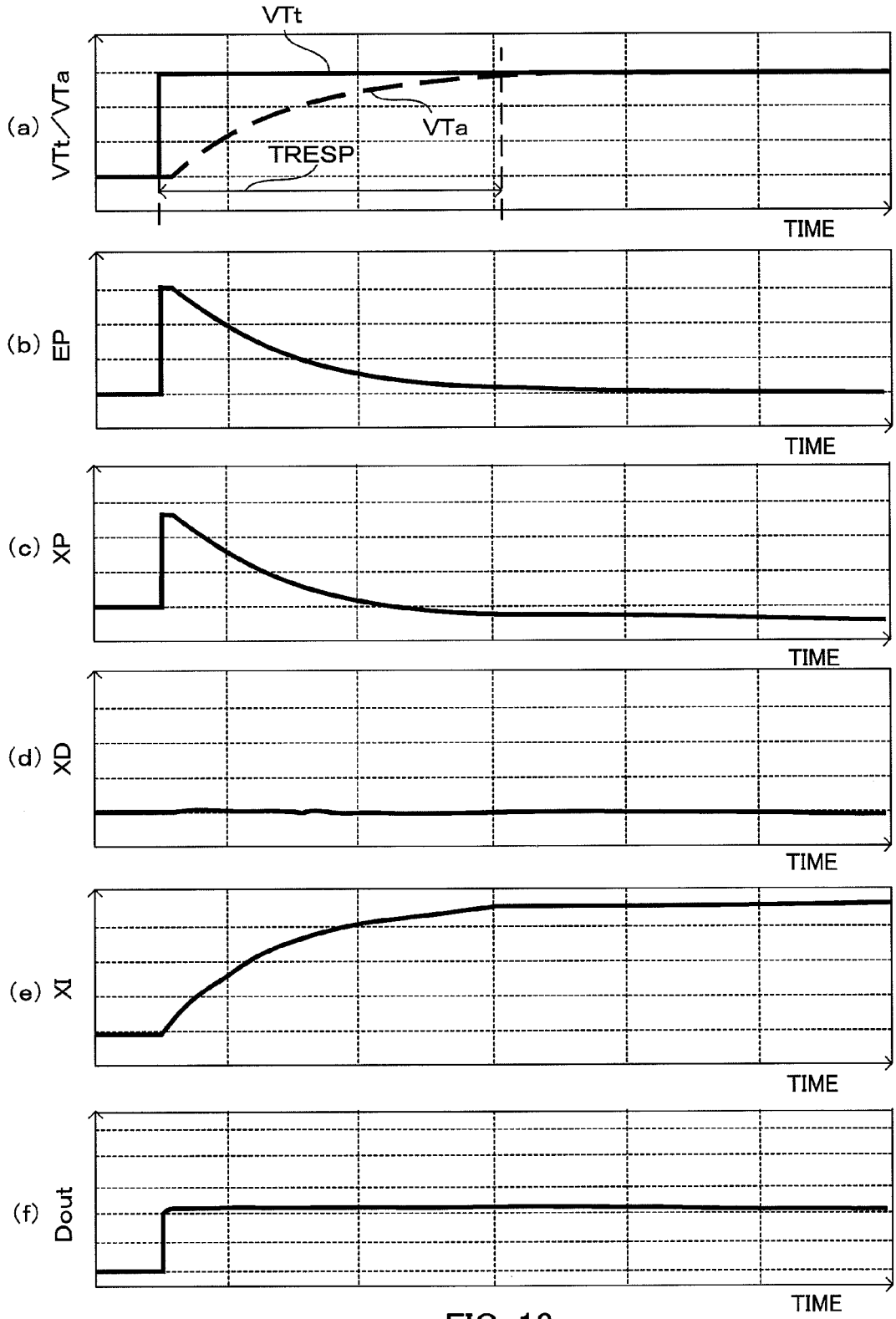
FIG. 13 are time charts of phase angle response at the time when the initial value of the integral term is set to 0.

FIG. 13 are time charts of phase angle response in a case where the initial value XI_ini of the integral term is set to 0. Referring to FIG. 13, when the target phase angle VTt is changed stepwise to a predetermined value as shown in FIG. 13A, the responsive operation waveform of the actual phase angle VTa is shown in FIG. 13A, the control difference EP in the phase angle calculated through PID control calculation is shown in FIG. 13B, the calculated value XP of the proportional term is shown in FIG. 13C, the calculated value XD of the differential term is shown in FIG. 13D, the calculated value XI of the integral term is shown in FIG. 13E, and the operation amount Dout is shown in FIG. 13F.

The initial value XI_ini of the integral term is set to 0 at the beginning of phase angle F/B control, so the amount of the oil supplied to the advancement chamber-side of the spool 32 of the OCV 3 is insufficient until the integral term XI reaches a state of equilibrium. Therefore, a time TRESP for convergence of the actual phase angle becomes long.

Figure 14:
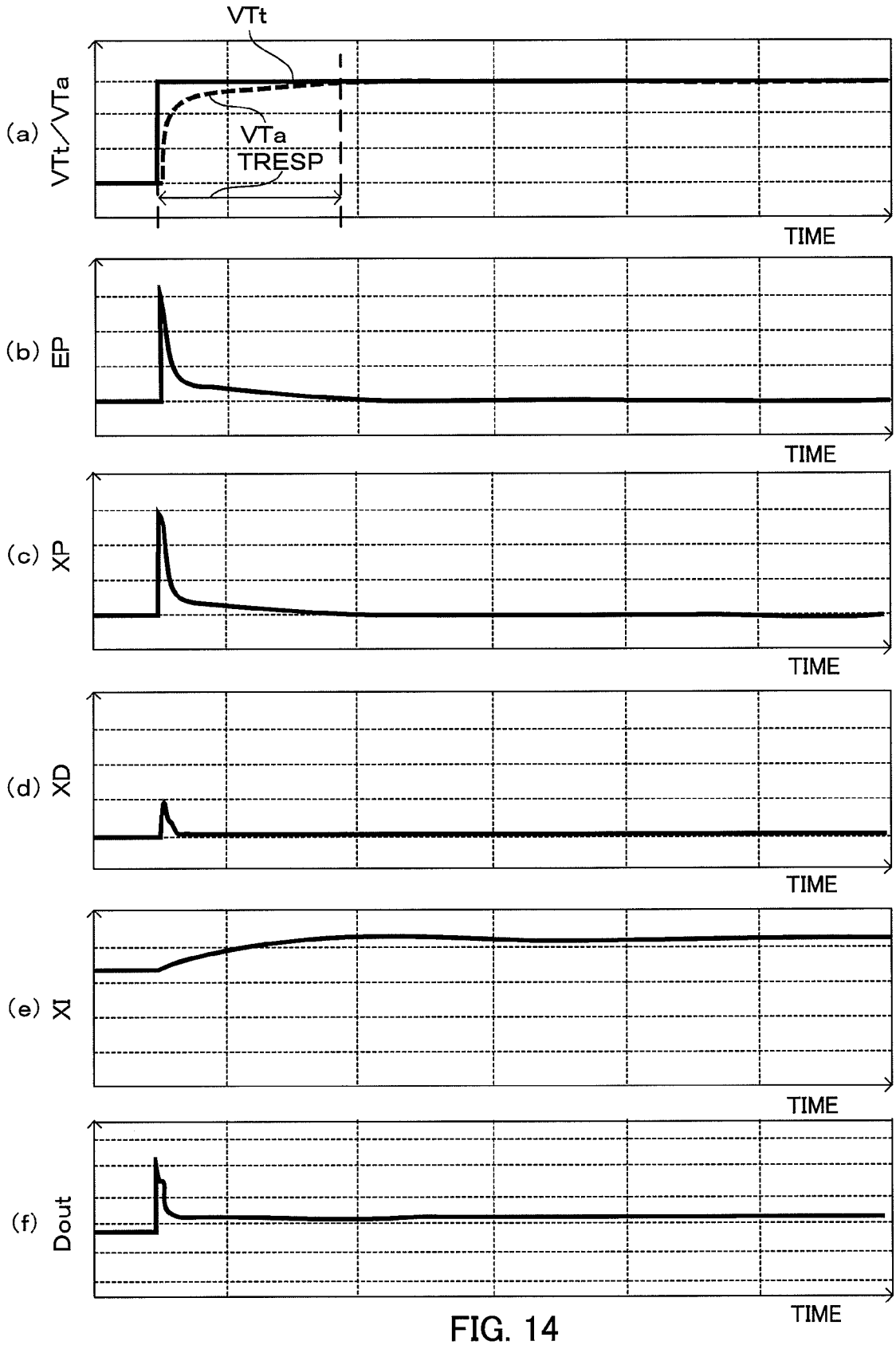
FIG. 14 are time charts of phase angle response at the time when the initial value of the integral term, which is calculated using a formula that is preset according to a tolerance lower-limit specification to calculate the initial value of the integral term, is set.

FIG. 14 are time charts of phase angle response in a case where the initial value XI_ini of the integral term at the beginning of phase angle F/B control, which is calculated using the formula for calculating the initial value of the integral term that is set in advance according to the tolerance lower-limit specification of the OCV 3. Referring to FIG. 14, when the target phase angle VTt is changed stepwise to a predetermined value as shown in FIG. 14A, the responsive operation waveform of the actual phase angle VTa is shown in FIG. 14A, the control difference EP in the phase angle calculated through PID control calculation is shown in FIG. 14B, the calculated value XP of the proportional term is shown in FIG. 14C, the calculated value XD of the differential term is shown in FIG. 14D, the calculated value XI of the integral term is shown in FIG. 14E, and the operation amount Dout is shown in FIG. 14F.

The initial value XI_ini of the integral term at the beginning of phase angle F/B control, which is calculated using the formula for calculating the initial value of the integral term that is set in advance according to the tolerance lower-limit specification of the OCV 3, is set, so the time TRESP for convergence of the actual phase angle VTa is reduced to about 2/5, as is apparent from a comparison of FIG. 14 with FIG. 13.

Figure 15:
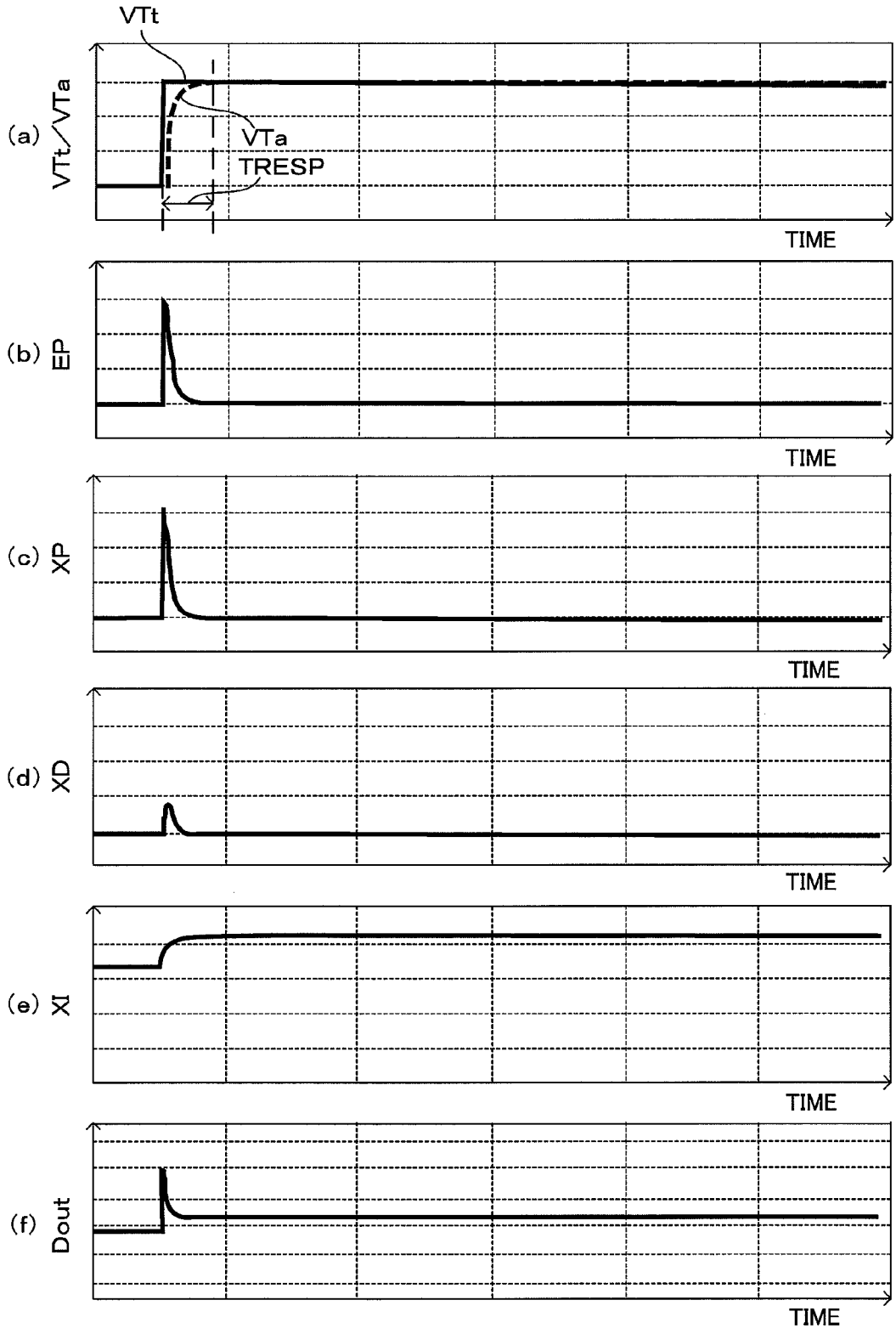
FIG. 15 are time charts of phase angle response at the time when the initial value of the integral term, which is calculated using the formula that is preset according to the tolerance lower-limit specification to calculate the initial value of the integral term, is set and an integral gain obtained by multiplying a control gain at a time of normal control is used.

FIG. 15 are time charts of phase angle response in a case where the initial value XI_ini of the integral term at the beginning of phase angle F/B control, which is calculated using the formula for calculating the initial value of the integral term that is set in advance according to the tolerance lower-limit specification of the OCV 3 in the same manner as in FIG. 14, is set, and the calculated value XI of the integral term is calculated to perform phase angle feedback control with the integral gain multiplication coefficient KI_MUL set equal to 4.0 until the control difference converges to a value equal to or smaller than a predetermined value. Referring to FIG. 15, when the target phase angle VTt is changed stepwise to a predetermined value as shown in FIG. 15A, the responsive operation waveform of the actual phase angle VTa is shown in FIG. 15A, the control difference EP in the phase angle calculated through PID control calculation is shown in FIG. 15B, the calculated value XP of the proportional term is shown in FIG. 15C, the calculated value XD of the differential term is shown in FIG. 15D, the calculated value XI of the integral term is shown in FIG. 15E, and the operation amount Dout is shown in FIG. 15F.

When the calculated value XI of the integral term is calculated to perform phase angle feedback control with the integral gain multiplication coefficient KI_MUL set equal to 4.0 until the control difference converges to the value equal to or smaller than the predetermined value, the time TRESP for convergence of the actual phase angle VTa is reduced to about 1/5, as is apparent from a comparison of FIG. 15 with FIG. 14.

In comparison with the case where the initial value XI_ini of the integral term is set equal to 0, the time TRESP for convergence is reduced to about 1/12.5, as is apparent from a comparison of FIG. 15 with FIG. 13.

The control apparatus for the internal combustion engine according to the present invention quickens the convergence of the actual phase angle to the target phase angle by setting the control gain to a large value obtained by multiplying the control gain at the time of normal control when the control difference is equal to or larger than the predetermined value during the first performance of phase angle feedback control, and returning the control gain to the control gain at the time of normal control in a case where the control difference has converged to the value smaller than the predetermined value.

Further, the amount of overshoot of the actual phase angle can be suppressed, and the actual position of the hydraulic pressure control solenoid valve in the holding state thereof does not deviate from the original neutral position to the advancement side.

Even in a case where the target phase angle is set on the advancement side where the amount of valve overlap between the intake valve and the exhaust valve is intrinsically large, the amount of valve overlap does not become excessively large. Thus, a deterioration in startability of the internal combustion engine resulting from an excessively large amount of internal EGR (amount of exhaust gas recirculation) can be avoided.

There is no need to impose a limit on the target phase angle on the advancement side, so the startability of the internal combustion engine at low temperature can be improved.

When the control difference during phase angle feedback control is equal to or larger than the predetermined value, the integral gain is set to a large value obtained by multiplying the integral gain at the time of normal control. In the case where the control difference has converged to the value smaller than the predetermined value, the integral gain is returned to the integral gain at the time of normal control to perform phase angle feedback control calculation. Therefore, the calculated value of the integral term corresponding to the holding of the hydraulic pressure control solenoid valve at the neutral position can be reached swiftly and smoothly, and excessive overshoot of the actual phase angle at the time of phase angle feedback control can be prevented. Also, the amount of valve overlap between the intake valve and the exhaust valve does not become excessively large, so stable combustibility is ensured.

The initial value of the integral term at the time when phase angle feedback control is performed for the first time is set using the formula for calculating the initial value of the integral term, which is set in advance with the temperature parameter of the internal combustion engine serving as an input. Therefore, for variations in the temperature or the voltage state in starting the internal combustion engine or the individual dispersion of the hydraulic pressure control solenoid valve, the setting of the initial value of the integral term at the beginning of phase angle feedback control can be configured with a simple control logic while ensuring high accuracy as well. Therefore, excessive overshoot of the actual phase angle at the beginning of phase angle feedback control can be prevented, and the amount of valve overlap between the intake valve and the exhaust valve does not become excessively large, so stable combustibility is ensured.

The coolant temperature data is used as the temperature parameter of the internal combustion engine, so the coolant temperature data can be diverted from the coolant temperature sensor provided already in the internal combustion engine. In consequence, an unnecessary rise in cost is not caused.

The formula for calculating the initial value of the integral term is derived and set in advance based on the tolerance lower limit of the current value for controlling the hydraulic pressure control solenoid valve to the neutral position, the tolerance lower limit of the resistance value of the solenoid coil of the hydraulic pressure control solenoid valve, and the temperature of the solenoid coil. Therefore, for variations in the temperature or the voltage state in starting the internal combustion engine or the individual dispersion of the hydraulic pressure control solenoid valve, the setting of the initial value of the integral term at the beginning of phase angle feedback control can be configured with a simple control logic while ensuring high accuracy as well. Therefore, excessive overshoot of the actual phase angle at the beginning of phase angle feedback control can be prevented, and the amount of valve overlap between the intake valve and the exhaust valve does not become excessively large, so stable combustibility is ensured.

In the formula for calculating the initial value of the integral term, the offset value is added to the product of the coolant temperature and the temperature coefficient, so the initial value of the integral term corresponding to changes in temperature or voltage can be set with a simple control logic.

The newest value of the calculated value of the integral term calculated through phase angle feedback control calculation is stored at the time of stoppage of phase angle feedback control when a KEY is ON, so the integral term at the time of resumption of phase angle feedback control calculation can be set with ease.

In resuming phase angle feedback control when the KEY is ON, the value obtained by subtracting the predetermined value from the stored newest value of the calculated value of the integral term is set as the initial value of the integral term. Therefore, the setting of the initial value of the integral term at the beginning of phase angle feedback control can be configured with a simple control logic while ensuring high setting accuracy as well. Therefore, excessive overshoot of the actual phase angle at the beginning of phase angle feedback control can be prevented, and the amount of valve overlap between the intake valve and the exhaust valve does not become excessively large, so stable combustibility is ensured.

When it is determined that the coolant temperature sensor for detecting the operational state of the internal combustion engine is out of order, the coolant temperature is calculated and set as the predetermined value set in advance, according to the formula for calculating the initial value of the integral term. Therefore, an effect of making it possible to avoid excessive overshoot of the actual phase angle at the beginning of phase angle feedback control is achieved.

When the calculated value of the initial value of the integral term deviates from the range defined by the upper limit and the lower limit of the initial value of the integral term set in advance, the setting of the initial value of the integral term is limited by the upper limit or the lower limit. Therefore, the setting of the initial value of the integral term outside the range defined by the upper limit and the lower limit of the tolerance for the individual dispersion of the hydraulic pressure control solenoid valve or the range defined by the upper limit and the lower limit of the operation temperature can be avoided.

In the control apparatus for the internal combustion engine according to the embodiment of the present invention, the initial value of the integral term is calculated according to the calculation formula based on the coolant temperature. However, the initial value of the integral term may be read from a coolant temperature table.

Also, the temperature of the solenoid coil 31 of the OCV 3 is estimated from the coolant temperature. However, the temperature of the solenoid coil 31 of the OCV 3 may be estimated from an oil temperature detected by an oil temperature sensor.

Further, the integral gain is multiplied. However, a similar effect is also achieved by multiplying the value input in calculating the integral term.

What is claimed is:

1. A control apparatus for an internal combustion engine which hydraulically drives a variable mechanism for continuously causing a rotational phase of a camshaft with respect to a crankshaft of the internal combustion engine to be variable by dint of a hydraulic pressure control solenoid valve to change timings for opening/closing at least one of an intake valve and an exhaust valve, the control apparatus comprising:

a crank angle sensor for detecting a reference rotational position of the crankshaft;

a cam angle sensor for detecting a reference rotational position of the camshaft;

means for detecting an actual phase angle of the camshaft based on detection signals from the crank angle sensor and the cam angle sensor;

means for detecting an operational state of the internal combustion engine;

means for setting a target phase angle of the camshaft based on an operational state detected by the operational state detecting means; and means for performing phase angle feedback control calculation so that the actual phase angle coincides with the target phase angle, to calculate an amount of operation for the hydraulic pressure control solenoid valve, wherein:

the phase angle feedback control calculation is started for a first time after a KEY is turned ON with an initial value of an integral term set to a predetermined value;

the phase angle feedback control calculation is performed using a control gain obtained by multiplying a control gain at a time of normal control when a control difference is equal to or larger than a preset value during the phase angle feedback control; and the phase angle feedback control calculation is performed using the control gain at the time of normal control when the control difference is smaller than the preset value during the phase angle feedback control.

2. A control apparatus for an internal combustion engine according to claim 1, wherein the control gain comprises an integral gain.

3. A control apparatus for an internal combustion engine according to claim 1, wherein the initial value of the integral term is set using a formula for calculating the initial value of the integral term which is preset with a temperature parameter of the internal combustion engine serving as an input.

4. A control apparatus for an internal combustion engine according to claim 3, wherein the temperature parameter of the internal combustion engine comprises a coolant temperature.

5. A control apparatus for an internal combustion engine according to claim 3, wherein the formula for calculating the initial value of the integral term comprises a calculation formula set based on a tolerance lower limit of a current value for controlling the hydraulic pressure control solenoid valve to a neutral position, a tolerance lower limit of a resistance value of a solenoid coil of the hydraulic pressure control solenoid valve, and a temperature of the solenoid coil.

6. A control apparatus for an internal combustion engine according to claim 3, wherein the formula for calculating the initial value of the integral term comprises a calculation formula for adding an offset value to a value obtained by multiplying the coolant temperature by a temperature coefficient.

7. A control apparatus for an internal combustion engine according to claim 1, wherein the integral term is calculated through the phase angle feedback control calculation with a newest value of a calculated value thereof stored when the phase angle feedback control is stopped while the KEY is ON.

8. A control apparatus for an internal combustion engine according to claim 7, wherein the initial value of the integral term is set to a value obtained by subtracting a predetermined value from the stored newest value of the calculated value of the integral term when the phase angle feedback control is resumed while the KEY is ON.

9. A control apparatus for an internal combustion engine according to any one of claim 1, wherein the initial value of the integral term is calculated with a preset value set as a coolant temperature when a coolant temperature sensor for detecting the operational state of the internal combustion engine is out of order.

10. A control apparatus for an internal combustion engine according to any one of claim 1, wherein:

the initial value of the integral term is set to a preset upper limit when the calculated value of the initial value of the integral term is larger than the upper limit; and the initial value of the integral term is set to a preset lower limit when the calculated value of the initial value of the integral term is smaller than the lower limit.

* * * * *